US012228364B2

(12) United States Patent
Chia

(10) Patent No.: US 12,228,364 B2
(45) Date of Patent: Feb. 18, 2025

(54) HIGH PERFORMANCE LAUNCHER OF SHORT PROJECTILES WITH STORAGE BELT

(71) Applicants: EASEBON SERVICES LIMITED, Kwun Tong (HK); Chia See Chong Francis, Hong Kong (HK)

(72) Inventor: Francis See Chong Chia, Kowloon (HK)

(73) Assignee: EASEBON SERVICES LIMITED, Kwun Tong (HK)

( * ) Notice: Subject to any disclaimer, the term of this patent is extended or adjusted under 35 U.S.C. 154(b) by 0 days.

(21) Appl. No.: 18/269,849

(22) PCT Filed: Apr. 1, 2021

(86) PCT No.: PCT/SG2021/050186

§ 371 (c)(1),
(2) Date: Jun. 27, 2023

(87) PCT Pub. No.: WO2022/146231

PCT Pub. Date: Jul. 7, 2022

(65) Prior Publication Data

US 2024/0044610 A1 Feb. 8, 2024

Related U.S. Application Data

(60) Provisional application No. 63/131,355, filed on Dec. 29, 2020.

(51) Int. Cl.
*F41B 11/89* (2013.01)
*F41A 9/30* (2006.01)
(Continued)

(52) U.S. Cl.
CPC ..... *F41B 11/89* (2013.01); *F41A 9/30* (2013.01); *F41B 11/646* (2013.01); *F41B 11/73* (2013.01)

(58) Field of Classification Search
CPC ..... F41B 11/89; F41B 11/646; F41B 11/73; F41A 9/30
(Continued)

(56) References Cited

U.S. PATENT DOCUMENTS 4,091,981 A 5/1978 Moriguchi et al.
4,137,821 A 2/1979 Benedict
(Continued)

FOREIGN PATENT DOCUMENTS

CN 201269715 Y 7/2009
CN 201964837 U 9/2011

OTHER PUBLICATIONS

International Search Report issued in Application No. PCT/SG2021/050186, dated Jul. 5, 2021.
(Continued)

*Primary Examiner* — Samir Abdosh
(74) *Attorney, Agent, or Firm* — Amster, Rothstein & Ebenstein LLP

(57) ABSTRACT

A toy projectile launcher having a storage belt, a launch barrel, a cocking slide, an air piston assembly that includes an air nozzle and an air piston barrel, and a housing is disclosed. The storage belt contains projectile holders that are adapted to hold a projectile, such as a foam dart. The cocking slide can be moved forward and backward. When the cocking slide is moved backward, the air piston barrel moves backward and the air nozzle is retracted from a projectile holder, providing clearance for advancing a next projectile holder into a firing position. When the cocking slide is moved forward, the next projectile holder is advanced into the firing position and the air nozzle pushes on the next projectile holder to form an airtight seal between the launch barrel and air piston assembly.

17 Claims, 11 Drawing Sheets

(51) Int. Cl.
*F41B 11/646* (2013.01)
*F41B 11/73* (2013.01)

(58) Field of Classification Search
USPC ..... 124/63
See application file for complete search history.

(56) References Cited

U.S. PATENT DOCUMENTS

| | | | | |
|---|---|---|---|---|
| 5,660,159 | A | 8/1997 | Clayton | |
| 8,127,753 | B1 | 3/2012 | Brooks et al. | |
| 9,389,042 | B1 * | 7/2016 | Clayton | F41B 11/642 |
| 2014/0083400 | A1 | 3/2014 | Falkowski, II et al. | |
| 2016/0187085 | A1 | 6/2016 | Wong et al. | |
| 2023/0074440 | A1 * | 3/2023 | Chia | F41B 11/54 |

OTHER PUBLICATIONS

Written Opinion issued in Application No. PCT/SG2021/050186, dated Jul. 5, 2021.
International Preliminary Report on Patentability and Written Opinion issued in Application No. PCT/SG2021/050186, dated Jul. 4, 2023.
Extended European search report issued in Application No. 21915960.5, dated Oct. 10, 2024.
European Communication pursuant to Rules 70(2) and 70a(2) EPC issued in Application No. 21915960.5, dated Oct. 29, 2024.

* cited by examiner

100

FIG. 3A
100
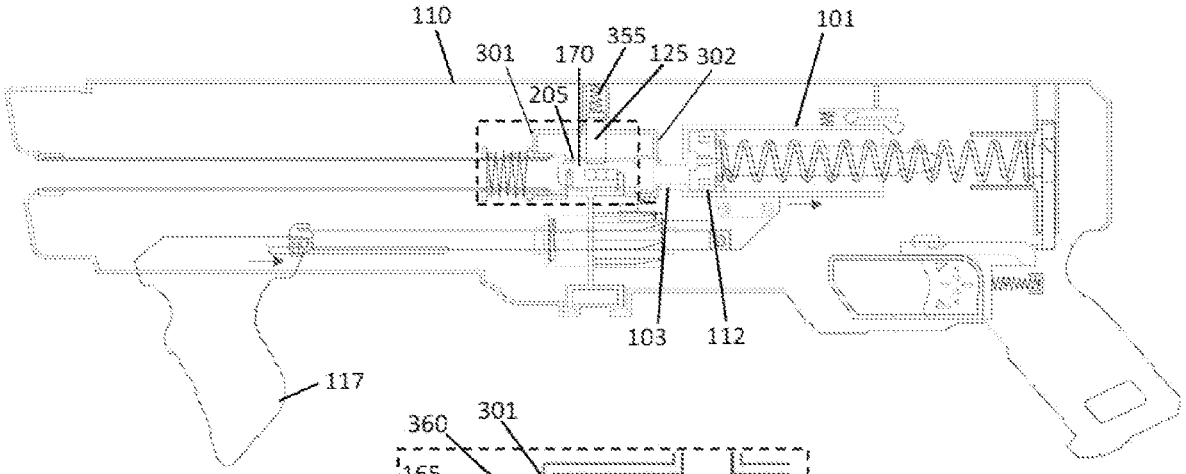
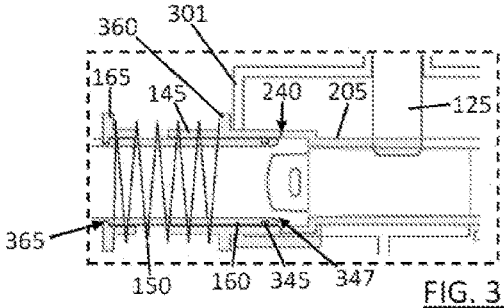
FIG. 3B

100

FIG. 8A
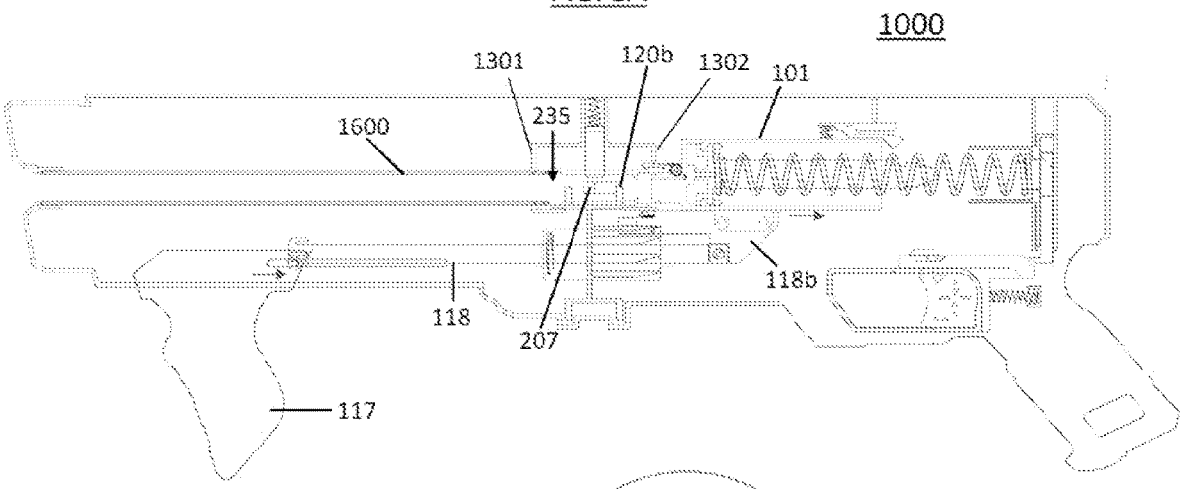
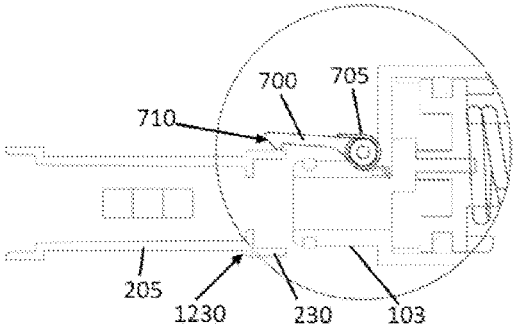
FIG. 8B

FIG. 10A
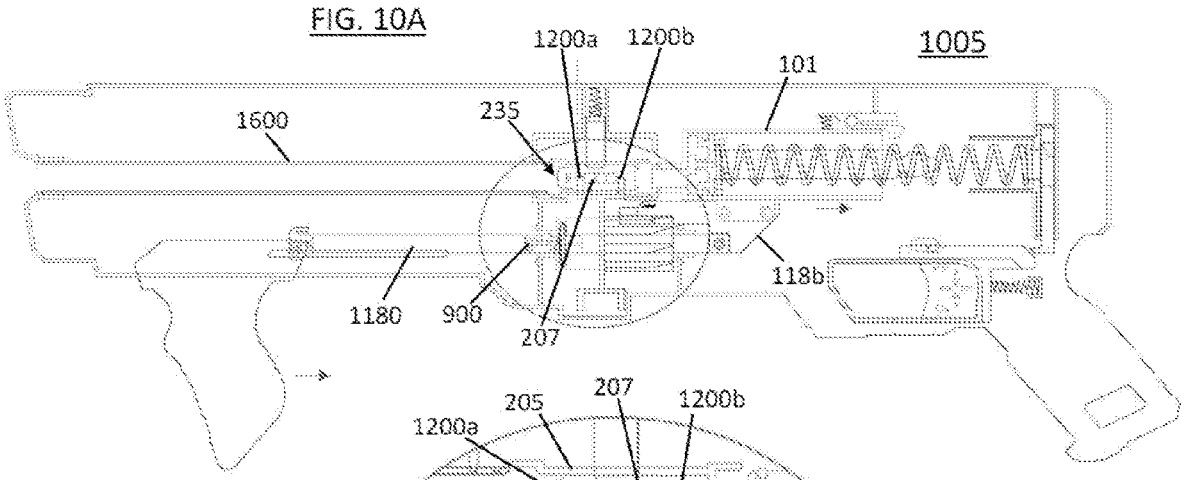
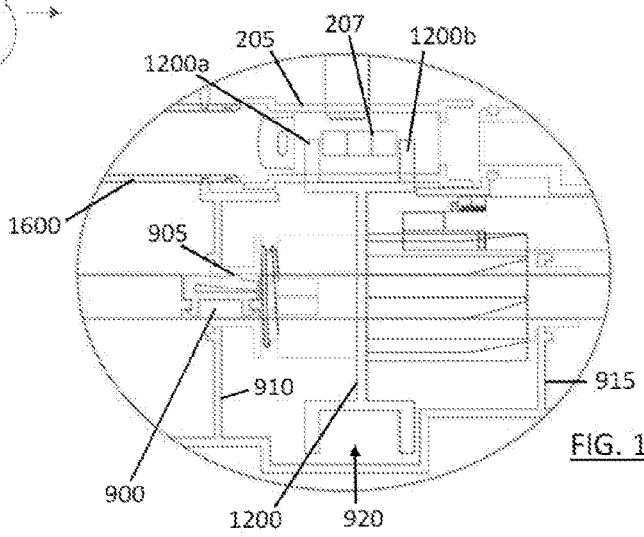
FIG. 10B

HIGH PERFORMANCE LAUNCHER OF SHORT PROJECTILES WITH STORAGE BELT

REFERENCE TO OTHER APPLICATIONS

This application claims the benefit of and priority to U.S. Provisional Patent Application No. 63/131,355, filed on Dec. 29, 2020, entitled "HIGH PERFORMANCE LAUNCHER OF SHORT PROJECTILES WITH STORAGE BELT," the contents of which are incorporated by reference herein in their entirety.

FIELD

The present disclosure is generally related to a toy projectile launcher, such as a toy pistol, gun, and the like, for launching toy projectiles, such as foam bullets, darts, balls, and the like, with a simplified construction and improved performance.

BACKGROUND

Traditional toy projectile launchers have utilized various forms of rifles, pistols, blasters, machine guns, and the like, for launching toy projectiles, such as foam balls and darts, to name two. Such toy launchers have varied in size, power, and storage capacity. More specifically, toy launchers of foam projectiles—bullets (or "darts"), balls, and the like—have become ubiquitous. One standard for foam bullets has been marketed under the brand name Nerf® with a rubber tip and a foam body that are approximately 71.5 mm in length. There have been various types of rifles, machine guns, and the like, that have been marketed for launching such foam projectiles.

The caps of the toy darts are generally made of a material other than foam that allows the dart to be shot from the launcher at a targeted person or object and/or propelled over an appropriate distance and/or at a relatively quick speed.

Conventional dart guns have traditionally been marketed to pre-teen children for casual play. More recently, in conjunction with the advent of special event war games—such as paintball, laser tag, and the like—higher-powered launchers have been developed to target enthusiasts for such special events using foam darts.

As an example, launchers having metal barrels, instead of plastic ones, have been used for improved launching velocity. Such launchers and darts are usually dimensioned to have a very small clearance between the inner diameter of the barrel of the launcher and the outer diameter of the dart so as to provide improved launching speed and accuracy.

With the above-mentioned metal-barreled launchers, there is still a need to further improve the launching force of the projectiles.

SUMMARY

To address the above, the present disclosure is generally related to an improved toy launcher for launching high performance foam darts. According to an exemplary embodiment of the present disclosure, one or more sealing mechanisms are provided to improve airtight seals from an air piston mechanism to a launch barrel of a toy projectile launcher. Advantageously, an effective and high-performance blaster may be realized that provides high velocity and accurate projectile launching.

Particularly, the present disclosure is directed to a toy launcher for receiving plural projectile holders that are connected to one another to form a belt, a chain, or the like. Accordingly, the present disclosure is directed to mechanisms in a launcher that take advantage of the flexible arrangement among such projectile holders to facilitate forming multiple airtight seals among components and to, thereby, form an airtight connection between a piston and a launch barrel for launching a projectile held in one of the holders. Additionally, the present disclosure is directed to a simplified construction for an improved integrated launcher with a two-step loading/priming and firing mechanism that incorporates improved airtight seals among elements of the launcher for realizing high launching force for compact projectiles.

According to an exemplary embodiment, the toy launcher includes a projectile holder, a launch barrel, an air piston assembly, and a cocking slide, wherein at least the projectile holder and the air piston assembly are coupled to the cocking slide.

According to an exemplary embodiment, the air piston assembly includes an air piston barrel, a plunger element, and a compression spring.

In embodiments, the toy launcher includes a coupling between the cocking slide and the air piston barrel.

In embodiments, the air piston barrel is movable to a backward position when the cocking slide is moved to the backward position.

In embodiments, a front portion of the air piston barrel pushes the plunger element to compress the compression spring against the rear wall of the toy launcher when the cocking slide is moved to the backward position.

In embodiments, a front nozzle of the air piston barrel abuts and pushes a rear part of the projectile holder in a forward direction when the air piston barrel is in a forward position.

In embodiments, the projectile holder is released from the front nozzle of the air piston barrel when the air piston barrel is moved to the backward position.

In embodiments, the toy launcher further includes a spring-loaded collar that abuts a front portion of the projectile holder.

In embodiments, the spring-loaded collar is biased towards a rearward direction.

In embodiments, the spring-loaded collar pushes on the projectile holder to move the projectile holder in the rearward direction when the projectile holder is released from the front nozzle.

In embodiments, the spring-loaded collar pushes the projectile holder in the rearward direction to move the projectile holder by at least 6 mm.

In embodiments, the front nozzle pushes a next projectile holder forward when the air piston barrel is moved from the backward position back to a forward position.

In embodiments, the front nozzle pushes the next projectile holder to move the next projectile holder in a forward direction by at least 6 mm.

In embodiments, the air piston barrel includes a front hook element that engages an outer ledge on the projectile holder.

In embodiments, the front hook element pulls the projectile holder in a rearward direction away from the launch barrel when the air piston barrel is moved to the backward position.

In embodiments, the hook element disengages from the outer ledge upon moving the projectile holder a predetermined distance.

In embodiments, the predetermined distance is at least 6 mm.

In embodiments, the hook element reengages the outer ledge when the air piston barrel is moved from the backward position back to a forward position.

In embodiments, the front nozzle is moved forward to form an airtight seal between the air piston barrel and a rear portion of the next projectile holder when the cocking slide is moved from the backward position to the forward position.

In embodiments, the projectile holder is pushed forward by the front nozzle to form an airtight seal between a rear portion of the launch barrel and a front portion of the projectile holder when the cocking slide is moved from the backward position to the forward position.

In embodiments, a rotatable projectile holder advancement mechanism is coupled to the cocking slide.

In embodiments, the projectile holder advancement mechanism rotates to advance to the next projectile holder when the cocking slide is moved from the backward position to the forward position.

In embodiments, a resilient member is coupled to the cocking slide.

In embodiments, the projectile holder advancement mechanism is movable in the forward and rearward directions in correspondence with the forward position and the backward position of the cocking slide.

In embodiments, the resilient member pushes the projectile holder advancement mechanism in the rearward direction when the cocking slide is moved to the backward position.

In embodiments, the projectile holder advancement mechanism moves the projectile holder in the rearward direction when the resilient member pushes the projectile holder advancement mechanism in the rearward direction.

In embodiments, the resilient member pushes the projectile holder advancement mechanism to move the projectile holder in the rearward direction by at least 6 mm.

In embodiments, the resilient member pushes the projectile holder advancement mechanism in the forward direction when the cocking slide is moved from the backward position to the forward position.

In embodiments, the projectile holder advancement mechanism moves the next projectile holder in the forward direction when the resilient member pushes the projectile holder advancement mechanism in the forward direction.

In embodiments, the resilient member pushes the projectile holder advancement mechanism to move the next projectile holder in the forward direction by at least 6 mm.

In embodiments, the plunger element is coupled to a trigger assembly when the air piston barrel is moved to the backward position.

In embodiments, the plunger element is retained in the backward position by the trigger assembly when air piston barrel is moved from the backward position to the forward position, wherein an internal air chamber is formed in the air piston barrel containing air drawn in from the front nozzle.

In embodiments, the plunger element is pushed forward by the compression spring to expel the air from the internal air chamber through the front nozzle of the air piston barrel behind a loaded projectile in the next projectile holder when a coupling between the plunger element and the trigger assembly is released.

In embodiments, in the firing position, the front nozzle of the air piston barrel is immediately adjacent the loaded projectile.

In embodiments, a toy projectile launcher comprises a housing; an air piston assembly, the air piston assembly including an air piston barrel, a plunger element, a first compression spring, and a front air nozzle; a cocking slide coupled to the air piston barrel; a launch barrel; and a storage belt including a plurality of projectile holders, wherein each projectile holder is adapted to contain a projectile, wherein, when the cocking slide is moved from a forward position to a backward position in a first priming step and, after the first priming step, from the backward position to the forward position in a second priming step: an internal air chamber is formed between a front portion of the air piston barrel and the plunger element; an advancement mechanism of the storage belt advances a next projectile holder into a firing position in front of the front air nozzle; and the front air nozzle pushes forward on a rear portion of the next projectile holder, forming an airtight seal from the air piston barrel to the rear portion of the next projectile holder, wherein an airtight seal is formed between a front portion of the next projectile holder and a rear portion of the launch barrel, and an airtight seal is formed between the air piston barrel to the rear portion of the launch barrel.

In embodiments, when the cocking slide is moved from the forward position to the backward position, a front portion of the air piston barrel pushes the plunger element to compress the first compression spring against a rear wall of the housing, wherein the plunger element and compression spring are held in place by a latching assembly.

In embodiments, the latching assembly is coupled between the plunger element and a trigger assembly, wherein the trigger assembly is adapted to be pulled backward by a user of the toy projectile launcher.

In embodiments, when the trigger assembly is pulled backward, the coupling of the latching assembly between the plunger element and trigger assembly is released, and the plunger element is pushed forward by the compression spring to expel air from the internal air chamber through the air nozzle disposed on the front portion of the air piston barrel behind the next projectile holder in the firing position.

In embodiments, the next projectile holder has a rear opening for accommodating the front air nozzle, wherein the rear opening has a diameter that is great-er than a diameter of a central portion of the next projectile holder.

In embodiments, the plunger element incorporates a first resilient O-ring that forms an airtight seal between the plunger element and an internal surface of the air piston barrel.

In embodiments, a second resilient O-ring is disposed around an outer circumference of the rear portion of the launch barrel so as to form an airtight seal between the rear portion of the launch barrel and a front end of the next projectile holder.

In embodiments, a third resilient O-ring is incorporated around an outer circumference of the front air nozzle so as to form an airtight seal between the front air nozzle and the rear portion of the next projectile holder.

In embodiments, the toy projectile launcher further comprises a barrel interface collar fitted over the launch barrel; and a second compression spring that biases the barrel interface collar in a rearward direction, wherein, when the cocking slide is moved from the forward position to the backward position: the front air nozzle is retracted from a rear portion of a first projectile holder of the plurality of projectile holders, wherein the first projectile holder is in the firing position in front of the front air nozzle; the second compression spring pushes the barrel interface collar in the rearward di-rection and away from the launch barrel; and the barrel interface collar pushes the first projectile holder away from the launch barrel, wherein the retraction of the front air nozzle provides a clearance for the advancement mechanism to advance the next projectile holder into the firing position; and wherein, when the cocking slide is moved from the backward position to the forward position: the next projectile holder pushes forward on the barrel interface collar, compressing the second compression spring, wherein the front portion of the next projectile holder is fitted over the rear portion of the launch barrel.

In embodiments, the barrel interface collar pushes the first projectile holder at least 6 mm in the rearward direction.

In embodiments, the front air nozzle pushes the next projectile holder forward at least 6 mm.

In embodiments, the front air nozzle has a spring-loaded hook element disposed thereon; wherein, when the cocking slide is moved from the forward position to the backward position: the spring-loaded hook element engages and pulls on a front ledge formed by a rear opening of the first projectile holder, pulling the first projectile holder in a rearward direction away from the launch barrel; and when the first projectile holder is pulled a predetermined distance in the rearward direction, the spring-loaded hook element disengages from the front ledge of the rear opening of the first projectile holder; wherein, when the cocking slide is moved from the backward position to the forward position: the spring-loaded hook element engages a front ledge of the rear opening of the next projectile holder; and a front end of the next projectile holder is fitted over a rear portion of the launch barrel.

In embodiments, the first projectile holder is pulled back at least 6 mm.

In embodiments, the toy projectile launcher further comprises a reciprocating frame; a resilient member coupled to the reciprocating frame, wherein the cocking slide coupled to the air piston barrel, the projectile holder advancement mechanism, and the resilient member; and wherein, when the cocking slide is moved from the forward position to the backward position: the resilient member engages and pushes the projectile holder advancement mech-anism in a rearward direction; the projectile holder advancement mechanism moves a first projectile holder in the rearward direction away from the launch barrel; and when the rotatable projectile holder advancement mechanism is moved a predetermined distance, the resilient member disengages from the projectile holder advancement mechanism; and the front air nozzle is retracted from a rear portion of a first projectile holder of the plurality of projectile holders, wherein the retraction of the front air nozzle provides a clearance for the storage belt to advance a next projectile holder into the firing position; and wherein, when the cocking slide is moved from the backward position to the forward position: the resilient member engages and pushes the projectile holder advancement mechanism in a forward direction; the projectile holder advancement mechanism moves the next projectile holder in the forward direction; the front air nozzle pushes forward on a rear portion of the next projectile holder; and a front end of the next projectile holder is fitted over a rear portion of the launch barrel.

In embodiments, when the cocking slide is moved from the forward position to the backward position, the resilient member pushes the projectile holder advancement mechanism by at least 6 mm in the rearward direction.

In embodiments, when the cocking slide is moved from the backward position to the forward position, the resilient member pushes the projectile holder advancement mechanism to move the next projectile holder by at least 6 mm in the forward direction.

In embodiments, the projectiles are foam darts.

In embodiments, a storage belt for use in a projectile launcher comprises a plurality of substantially cylindrical projectile holders each adapted to contain a projectile and having a projectile holder section and a rear opening section; and a rear end ring between the holder section and the rear opening section adapted to retain the projectile within the projectile holder, the rear opening section having a larger diameter than the projectile holder section.

In embodiments, a storage belt for use in a projectile launcher wherein each projectile holder is adapted to move forward and rearward relative to the next adjacent projectile holder in the storage belt.

BRIEF DESCRIPTION OF THE DRAWINGS

Exemplary embodiments of the present disclosure will be described with references to the accompanying figures, wherein:

FIG. 3A is a schematic partial cross-sectional side view of the toy projectile launcher of FIG. 1 with a cocking slide or handle being pulled towards a rearward loading and priming (cocked) position according to an exemplary embodiment of the present disclosure.

FIG. 3B is an inset closeup cross-sectional side view illustrating details of the barrel interface assembly of the launcher shown in FIG. 3A according to an exemplary embodiment of the present disclosure.

FIG. 8A is a schematic partial cross-sectional side view of the toy projectile launcher of FIG. 7A with a cocking slide or handle being pulled towards a rearward loading and priming (cocked) position according to another exemplary embodiment of the present disclosure.

FIG. 8B is an inset closeup cross-sectional side view illustrating details of the hook element of the launcher shown in FIG. 8A according to another exemplary embodiment of the present disclosure.

FIG. 10A is a schematic partial cross-sectional side view of the toy projectile launcher of FIG. 9A with a cocking slide or handle being pulled towards a rearward loading and priming (cocked) position according to yet another exemplary embodiment of the present disclosure.

FIG. 10B is an inset closeup cross-sectional side view illustrating details of the resilient member of the launcher shown in FIG. 10A according to yet another exemplary embodiment of the present disclosure.

DETAILED DESCRIPTION

The present disclosure is generally related to an improved toy launcher with an assembly for sealing a launch barrel to thereby improve the air pressure launch force. To achieve this objective, according to an exemplary embodiment, a toy launcher incorporates internal sealing assemblies for improving airway seals between an air piston assembly and a launch barrel.

Figure 1:
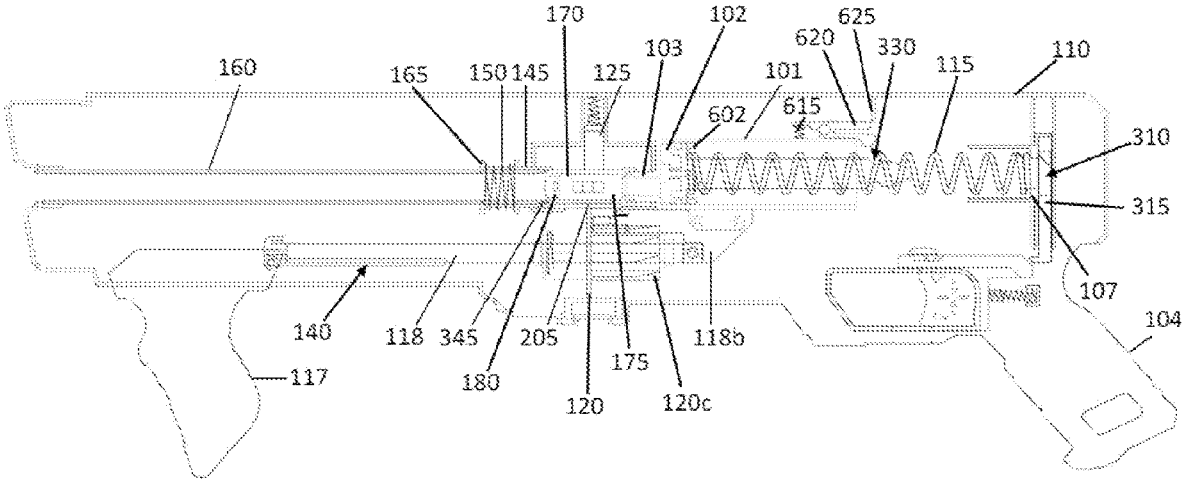
FIG. 1 is a schematic partial cross-sectional side view of key elements of a toy projectile launcher according to an exemplary embodiment of the present disclosure.

FIG. 1 is a schematic partial cross-sectional view of key elements of a toy projectile launcher 100 according to an exemplary embodiment of the present disclosure. For clarity and simplicity in illustrating the key elements and mechanisms of toy projectile launcher 100, portions that are not necessary to understand the scope and the spirit of the present disclosure are not shown. One of ordinary skill in the art would readily understand the supporting elements needed to house and support the various illustrated elements, including those that facilitate the accommodation and advancement of belt 105 (see FIG. 2A) into and out of launcher 100, with various design choices that would not depart from the spirit and scope of the present disclosure.

FIG. 1 is a schematic side cross-sectional view of a projectile launcher 100 in an un-cocked position according to an exemplary embodiment of the present disclosure. As shown in FIG. 1, projectile launcher 100 is shaped to resemble a belt or chain fed machine gun. In embodiments, launcher 100 may be in various other shapes and arrangements without departing from the spirit and the scope of the disclosure, as detailed below. As illustrated in FIG. 1, a reciprocating air piston assembly comprised of a barrel 101, a plunger element 102, and a front air nozzle 103 disposed within a housing 110 of the projectile launcher 100 between a handle 104 and a projectile holder advancement mechanism 120. As will be described in further detail below, projectile holder advancement mechanism 120 is adapted to advance a belt 105 (see FIG.>2A) having a series of projectile holders 205 that are linked together so that a next projectile—for example, foam dart 170—is loaded and primed for launch. According to an exemplary embodiment, barrel 101 of the air piston assembly has a generally rounded cylindrical or an oval shape and plunger element 102 is biased against a back wall 107 of the rear part of launcher housing 110 by a compression spring 115. The plunger element 102 incorporates a size and a shape that correspond with an internal circumference of barrel 101 so as to form an airtight seal with an internal surface of barrel 101. According to an exemplary embodiment of the present disclosure, plunger element 102 incorporates a resilient O-ring (made from a resilient material, such as a polymer) 112 (FIG. 3) to form an improved seal. As shown in FIG. 1, barrel 101 is coupled to a cocking slide (front handle) 117 via a reciprocating frame 118—which, in an exemplary embodiment, extends through a central opening of a rotary portion of advancement mechanism 120 to the rear portion of launcher 100 and connects to a coupling portion 118*b*, as illustrated in FIG. 1—that is fittingly coupled to, along with cocking slide 117, a track 140 incorporated on the front portion in the housing 110 of launcher 100. In embodiments, reciprocating frame 118 and coupling portion 118*b* may be formed by an integrated singular component. As will be described in further detail below, reciprocating frame 118 moves back and forth when cocking slide 117 is cocked back and forth in a manner similar to a pump action shotgun, which, in turn, primes the air piston assembly while feeding a foam dart 170 for launch.

As described above, reciprocating frame 118 slidably engages track 140 so that it is moved back and forth by a user moving cocking slide 117 back and forth. As shown in FIG. 1, projectile holder advancement mechanism 120 incorporates a series of slanted surfaces to form a rotary gear mechanism (section) 120*c* for engaging a corresponding slanted surface block 402 on coupling portion 118*b* (see FIG. 4) for advancing belt 105 to a next dart holder 205 upon a forward stroke on cocking slide 117—in other words, from the position shown in FIG. 4 back to the position shown in FIG. 6A, as will be described in further detail below. In embodiments, another series of mutually engaging slanted surfaces (not shown) on coupling portion 118*b* and projectile holder advancement mechanism 120, respectively, may be incorporated to begin the above-noted advancement of belt 105 to a next dart holder 205 upon a backward stroke—from the position shown in FIG. 1 to the position shown in FIG. 4—on cocking slide 117. As will be described in further detail below, belt 105 for holding projectiles—such as foam darts/bullets and the like—would be advanced by the engagement among slanted surfaces on gear section 120*c* and engagement arm 402 such that a next projectile would be delivered to a firing position. Correspondingly, a spring-loaded stopper block 125 is incorporated in the top portion of housing 110 for holding an appropriate, next dart holder 205 of belt 105 into an aligned position when belt 105 is advanced via projectile holder advancement mechanism 120.

In the illustrated embodiment, belt 105 is configured to hold toy darts 170. Darts 170 may be loaded into each dart holder 205 of belt 105 before belt 105 is loaded into launcher

100 and/or darts may be loaded and/or refilled while belt 105 is loaded into launcher 100—for example, forming a looped belt 105.

As illustrated in FIG. 1, an extension barrel interface collar 145 is fitted over launch barrel 160 and is biased against a launch barrel holder 165 by a compression spring 150. Launch barrel holder 165 is affixed to or integrated with housing 110 to serve as an anchor to compression spring 150 for biasing barrel interface collar 145 in the rearward direction towards dart holder 205. In embodiments, launch barrel holder 165 is fixed to and surrounds at least a portion of launch barrel 160. In embodiments, compression spring 150 may be biased against an alternative wall (not shown) disposed in the housing 110 of launcher 100. As will be described in further detail below, barrel interface collar 145 is biased towards the rear of launcher 100 against launch barrel holder 165 via spring 150 (see FIG. 2C) and, thereby, pushes a dart holder 205 back into a general alignment with the remainder of belt 105 so that belt 105 can be advanced to a next dart holder 205 in a first, pull-back, priming step by a user on cocking slide 117, which would also move the air piston assembly—i.e., barrel 101 and plunger element 102—backward.

Figure 2A:
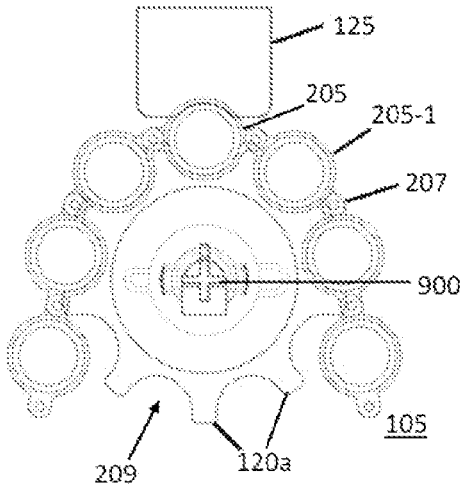
FIG. 2A is a front view of a feed belt for use with the launcher shown in FIG. 1 according to an exemplary embodiment of the present disclosure.
Figure 4:
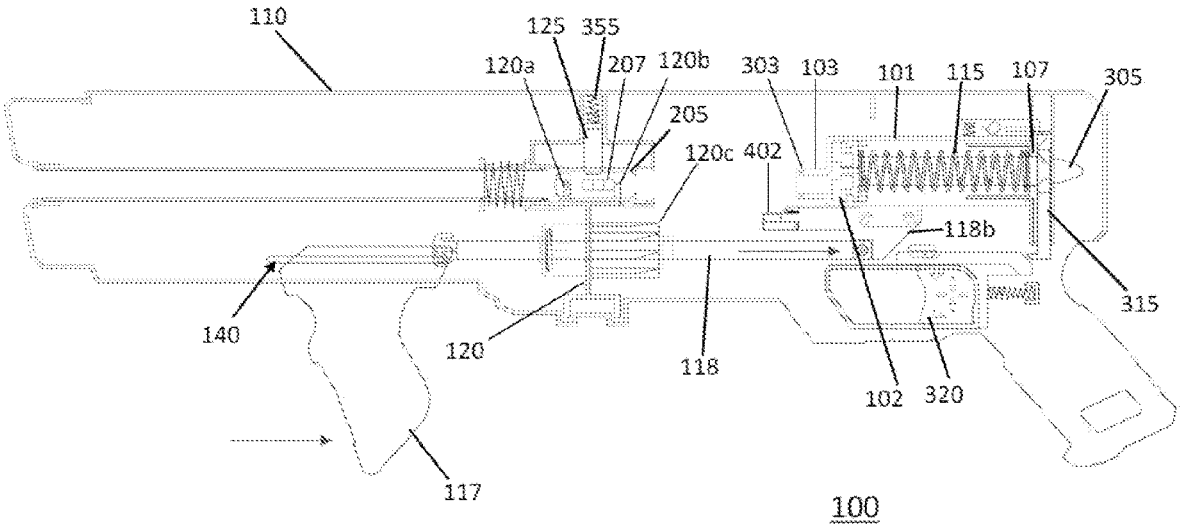
FIG. 4 is a schematic partial cross-sectional side view of the toy projectile launcher of FIG. 3A with the cocking slide or handle being placed fully in the rearward loading and priming (cocked) position according to an exemplary embodiment of the present disclosure.

FIG. 2A is a schematic front view of belt 105 according to an exemplary embodiment of the present invention. In FIG. 2A, a section of belt 105 that includes seven (7) dart holders 205, each dimensioned to accommodate a foam dart 170 (FIG. 1) for use with launcher 100, is shown. The dart holders 205 are connected to one another via a hinge 207—for example, a snap joint or a metal shaft—along a single row to form a mutable belt 105. As illustrated in FIG. 2A, each dart holder 205 fits into a corresponding opening 209 around a circumference of advancement mechanism 120. In accordance with an exemplary embodiment, each opening 209 is formed by two (2) pairs of a front prong 120*a* and a rear prong 120*b* (see FIG. 4). Front prongs 120*a* and rear prongs 120*b* are dimensioned to abut hinge 207 between dart holders 205 and to push on the outside surface of dart holders 205 for moving and advancing belt 105 as advancement mechanism 120 is rotated. Advancement mechanism 120, through the engagement among the slanted surfaces described above and in further detail below, is rotatable either in the clockwise or the counterclockwise direction in the configuration shown in FIG. 2A. Thus, belt 105 is advanced to a next dart holder 205 by such a rotation of advancement mechanism 120. As further illustrated in FIG. 2A, launcher 100 incorporates a spring-loaded stopper block 125 that exerts a downward force on a next dart holder 205 on belt 105 with a lower edge that is shaped to hold the next dart holder 205 in alignment. As advancement mechanism 120 is rotated, the upper surfaces on belt 105 push upward to lift block 125 when user cocks slide handle 117 backward until a next dart holder 205 comes into substantial alignment with block 125, which then exerts a downward force and holds the next dart holder 205 in alignment after cocking slide 117 is returned fully to the forward position by the user. With reference to FIGS. 1 and 4, front prongs 120*a* and rear prongs 120*b* of advancement mechanism 120 are spaced apart so as to provide clearance for hinges 207 between dart holders 205 to move from the forward position shown in FIG. 1 to the rearward position shown in FIG. 4.

In embodiments, a first and a last dart holder 205 of belt 105 may be connected to each other via a hinge 207 so that belt 105 is formed into a loop—and, thus, nonremovable from launcher 100. Having a belt 105 as a separable component may be desirable for purposes such as for compact packaging and shipping of launcher 100, or replacing belt 105 as needed or desired (e.g., if broken or for use in launching a different type of projectile, to name two) or to enable a user to carry a second loaded belt to increase the user's firepower. Belt 105 may incorporate any number of dart holders 205 and, in embodiments, the hinge connections 207 may be detachable by the user so that belt 105 can be customized to a desired size and capacity.

Figure 2B:
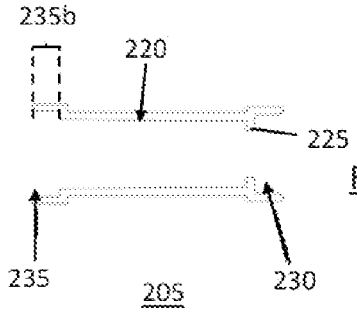
FIG. 2B is an inset cross-sectional side view of one dart-holding chamber of the belt shown in FIG. 2A according to an exemplary embodiment of the present disclosure.

FIG. 2B is a cross-sectional view of an individual dart holder 205 on belt 105 for holding dart 170, which as shown in FIG. 1 has an elongate dart body 175 and a cap 180 that is affixed to the dart body. Dart body 175 has a substantially cylindrical shape and comprises a foam material, or the like, and cap 180 comprises a rubber material, or the like. In embodiments, dart 170 may have a total length, e.g., within a range of approximately 33 mm to 45 mm, such as 35 mm, 36 mm, 37 mm, or 40 mm, to name a few. Correspondingly, dart 170 may have an outer cross-sectional diameter at its widest point of 12.9 mm. In alternative embodiments, dart 170 may have an outer cross-sectional diameter at its widest point of, for example, 12.5 mm, 13 mm, 14 mm, or 15 mm, to name a few. In embodiments, dart 170 may incorporate one or more recesses and corresponding ridges on its foam body—for example, as disclosed in U.S. patent application Ser. No. 16/895,172 filed on Jun. 8, 2020, the entire contents of which are incorporated by reference herein. As illustrated in FIG. 2B, each dart holder 205 includes a main central portion 220, which is formed in the shape of a cylinder with a cross-sectional diameter of about 13 mm for fitting and holding the widest point(s) of the foam body of dart 170. As further illustrated in FIG. 2B, each holder 205 includes a rear end ring 225 that extends inward to form an opening that is smaller in diameter than the main central portion 220. Ring 225 serves to abut the rear end of each dart 170 that is loaded into dart holder 205 by insertion though a front end 235, as well as to abut the front end of nozzle 103, as illustrated in FIG. 1. According to an exemplary embodiment of the present disclosure, the opening formed by rear end ring 225 has a diameter of about 9 mm for allowing compressed air from nozzle 103 to pass through to dart 170 to be launched. As shown in FIG. 2B, a rear opening 230 extending in the rearward direction from ring 225 has a larger cross-sectional diameter than main portion 220 for accommodating nozzle 103 to form an airtight seal from air piston barrel 101 to the rear end of dart 170. Correspondingly, front opening 235 extending from the front of main central portion 220 also has a larger cross-sectional diameter than main portion 220 in order to accommodate launch barrel 160 and to form an airtight seal from main portion 220 to launch barrel 160, as illustrated in FIG. 2C.

Figure 2C:
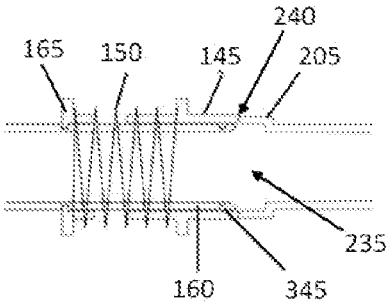
FIG. 2C is an inset cross-sectional side view of a barrel interface assembly according to an exemplary embodiment of the present disclosure.

FIG. 2C is a cross-sectional view of the interface between dart holder 205 and launch barrel 160 and, correspondingly, between front end 235 of dart holder 205 and spring-loaded barrel interface collar 145. In contrast to the configuration shown in FIG. 1, the configuration shown in FIG. 2C corresponds to the configuration shown in FIG. 3 after a user pulls back on cocking slide 117. As shown in FIG. 1, when the cocking slide 117 is in the forward position, nozzle 103 is in a forward position and, thus, pushes forward on the rear facing surface of ring 225 in dart holder 205. Consequently, dart holder 205 is pushed forward against barrel interface collar 145 until main portion 220 of dart holder 205 is connected to launch barrel 160. Referring now to FIG. 2C, a circumference of the front end 235 of dart holder 205 is substantially the same as the circumference of barrel interface collar 145, forming an abutting interface 240 between dart holder 205 and barrel interface collar 145. Accordingly, in the forward configuration illustrated in FIG. 1, front end 235 of dart holder 205 pushes on barrel interface collar 145 at interface 240, compressing spring 150 against launch barrel holder 165, until main portion 220 meets launch barrel 160. As illustrated in FIGS. 1 and 2C, a resilient O-ring 345 is disposed around an outer circumference at a rear end of launch barrel 160 so that in the forward position shown in FIG. 1, an improved airtight seal is formed with front end 235 of dart holder 205.

According to an exemplary embodiment, launch barrel 160 has an inner diameter of approximately 13.26 mm to provide minimal clearance for dart 170, which each has an outer diameter of approximately 13 mm. Accordingly, front opening 235 is dimensioned to accommodate launch barrel 160, having a slightly enlarged inner diameter in comparison to the inner diameter of main portion 220 for a fitted hold of dart 170. According to an exemplary embodiment, front opening 235 has an inner diameter of about 16.2 mm and rear opening 230 has an inner diameter of about 14.8 mm. Main portion 220 has an interior diameter of about 12.9 mm and may be flared slightly from ring 225 to front end 235—in other words, having a slightly larger interior circumference towards front end 235—to allow for inserting each dart 170 from front end 235 to abut ring 225 and for holding each dart 170 in place. As an example, the interior diameter of main portion 220 near front end 235 is slightly more than 12.9 mm and the interior diameter of main portion 220 near ring 225 is slightly less than 12.9 mm.

FIG. 3A is a schematic partial cross-sectional side view of the toy projectile launcher 100 of FIG. 1 in a position where a user has begun pulling back on cocking slide 117 according to an exemplary embodiment of the present disclosure. FIG. 3B is an inset closeup cross-sectional side view illustrating details of the interface among barrel interface collar 145, launch barrel 160, and dart holder 205 of belt 105 according to an exemplary embodiment of the present disclosure.

As cocking slide 117 is pulled back (see rearward arrow at cocking slide 117 in FIG. 3A), air piston barrel 101 is also pushed rearward via reciprocating frame 118 (and coupling portion 118*b*). Accordingly, air piston nozzle 103 is retracted from the rear of dart holder 205 and, as described above with reference to FIG. 2C, compression spring 150 pushes on barrel interface collar 145, which in turn pushes dart holder 205 backwards away from launch barrel 160. As illustrated in FIG. 3A, housing 110 of launcher 100 incorporates a front wall 301 and a rear wall 302 that together define an opening through which belt 105 may extend between the left and right sides of launcher 100. In accordance with an exemplary embodiment of the present disclosure, the front wall 301 and rear wall 302 are distanced from each other to provide for the full length of dart holder 205 of belt 105 with additional clearances at the front and back of belt 105—i.e., dart holder 205 shown in FIG. 3A—so as to provide for advancing belt 105 to a next dart holder 205 either from a left side to a right side of launcher 100, or vice versa. As shown in FIG. 3A, as the user pulls back on cocking slide 117, air piston nozzle 103 retracts fully from an opening in rear wall 302, thus clearing from the rear of dart holder 205 and belt 105 to allow for their movement and advancement.

FIG. 3B is a closeup of the front seal interface between dart holder 205 and launch barrel 160 via spring-loaded barrel interface collar 145 shown in FIG. 3A. As the user begins to pull back on the cocking slide 117 and as air piston nozzle 103 is retracted from the rear of dart holder 205, dart holder 205 no longer exerts a forward pushing force on barrel interface collar 145. Accordingly, as illustrated in FIG. 3B, spring 150 expands and pushes against launch barrel holder 165, which is fixed to housing 110 of launcher 100. Spring 150, thus, pushes barrel interface collar 145 rearward, which, in turn, pushes dart holder 205 rearward at interface 240. As illustrated in FIG. 3B, barrel interface collar 145 incorporates a ring 360 that extends radially around a main cylindrical body that is fitted around launch barrel 160 and that abuts, on the rear end, the front of dart holder 205 at interface 240. The ring 360 provides a front surface on which spring 150 can push collar 145 rearward and provides a rear facing surface that abuts front wall 301 as a limit to the rearward movement of collar 145. According to an exemplary embodiment, ring 360 and collar 145 are dimensioned so that a distance traveled by collar 145—and, correspondingly, dart holder 205—between the sealed configuration of launch barrel 160 and dart holder 205 shown in FIG. 1 and the unsealed configuration shown in FIGS. 3A and 3B is at least approximately 6 mm., which corresponds substantially to the length 235*b* (see FIG. 2B) of the widened section at the front opening 235 of dart holder 205. As further illustrated in FIG. 3B, launch barrel holder (anchor) 165 is fixed to launch barrel 160 via an interlocking structure 365, thus providing stability to launch barrel 160 and stability to the airtight seal formed between launch barrel 160 and dart holder 205. Additionally, the rear end of launch barrel 160 may incorporate a resilient O-ring 345 to further improve the airtight seal between launch barrel 160 and main central portion 220 of a dart holder 205 when the rear end of launch barrel 160 is inserted into front opening 235 of dart holder 205 by virtual of dart holder 205 being pushed forward by piston air nozzle 103—for example, in the configuration shown in FIG. 1 (and FIG. 5 described below). According to an exemplary embodiment, the rear trailing interior edge of launch barrel 160 incorporates a chamfered edge 347 around the interior circumference of launch barrel 160 to provide additional clearance for launching darts 170 and to avoid possible obstructions to such launchings by a cornered edge at the joint between main section 220 of dart holder 205 (see FIG. 2B) and launch barrel 160 in the launch configuration shown in FIG. 4 (i.e., with launch barrel 160 in the rearward position as also illustrated in FIG. 3B).

FIG. 4 is a schematic partial cross-sectional side view of the toy projectile launcher 100 of FIG. 1 with cocking slide 117 being completely pulled back and placed in a rearward loading and priming (cocked) position according to an exemplary embodiment of the present disclosure.

As shown in FIG. 4, air piston barrel 101 is coupled to cocking slide 117 via reciprocating frame 118, which may incorporate a coupling portion 118*b* for attachment to air piston barrel 101. The coupling between cocking slide 117 and air piston barrel 101 via frame 118 allows a user to pull back barrel 101 and plunger element 102 in a first, pull-back, priming step. As shown in FIG. 4, spring 115 is compressed between plunger element 102 and back wall 107. Advantageously, plunger element 102 starts at a position near a front portion of barrel 101, as shown in FIG. 1, and, therefore, compression spring 115 may be fully compressed in the position illustrated in FIG. 4.

According to an exemplary embodiment of the present disclosure, back wall 107 includes an aperture that allows a dome-shaped rod portion 305 to extend through and past another aperture 310 (FIG. 1) that is incorporated in a spring-loaded plate 315 that is, in turn, coupled to a trigger assembly 320. When a user pulls cocking slide 117 backward in a fashion similar to a pump action rifle (see rearward arrow adjacent cocking slide 117 in FIG. 4), a block/frame (not shown) pushes on frame 118 so that barrel 101, plunger 102, and rod portion 305 are pushed back as well. Plate 315 may be coupled to a compression spring (not shown) that biases plate 315 downward towards a trigger assembly 320. According to an exemplary embodiment of the disclosure, the leading edge of dome-shaped rod portion 305 is rounded and when it is pushed backward, the rounded leading sloped edge pushes upward on a top edge of aperture 310 (FIG. 1) in plate 315 so that rod portion 305 can be pushed through aperture 310 from the front of plate 315 to clear an opposing back side of plate 315, as illustrated in FIGS. 1 and 4. Once rod portion 305 is pushed sufficiently past plate 315 through aperture 310, plate 315 moves downward into engagement with a notch or recess 330 (see FIG. 1) opposite the rounded face of rod portion 305 so that rod portion 305—and, correspondingly, plunger element 102—is engaged with, and temporarily retained in place by plate 315. As shown in FIG. 4, the notch 330 hooks to the opposing back side of plate 315 above aperture 310 once plate 315 is pushed downwardly—by, say, the compression spring (not shown)—into notch 330 and, accordingly, a top edge of aperture 310 is pushed into a bottom surface of notch 330 (see FIGS. 1 and 4)—thus, plate 315 and notch 330 together form a latching assembly for holding rod portion 305 in the backward position.

As further shown in FIG. 4 and described above, with plunger element 102 and rod portion 305 pushed back by frame 118, spring 115 is compressed against the back wall 107 of main launcher housing 110 in the position at which plate 315 and notch 330 are hooked and engaged with each other. The rear end of track 140 serves as a limit to the rearward movement of cocking slide 117, as illustrated in FIG. 4. In alternative embodiments, an additional structural stop (not shown) may be used to limit the backward motion of cocking slide 117 to the above full extension position—i.e., the engagement position between notch 330 and plate 315.

Again, with barrel 101 and cocking slide 117 moved back to the configuration shown in FIG. 4, nozzle 103 is pulled back away from the rear opening 230 of one of the dart holders 205 in belt 105, thus clearing the way on the rear end for belt 105 to advance to a next dart holder 205. On the front end, with nozzle 103 no longer pushing forward against the rear opening 230 of dart holder 205, front opening 235 of dart holder 205 is pushed back by barrel interface collar 145 (at interface 240 shown in FIG. 3B) and thereby retracted from launch barrel 160. Accordingly, belt 105 is cleared to advance to a next dart holder 205 on the front end. As shown in FIG. 4, with dart holder 205 pushed rearward by collar 145, hinge 207 between the dart holders 205 on belt 105 is moved from abutting the front prong 120*a* (see FIG. 1) to abutting the rear prong 120*b* (see FIGS. 3A and 4) of advancement mechanism 120. In accordance with an exemplary embodiment, front prongs 120*a* and rear prongs 120*b* of advancement mechanism 120 may be spaced apart at a distance to allow for at least approximately 6 mm of movement for hinge 207 from the position shown in FIG. 1 to the position shown in FIGS. 3A and 4, which again corresponds substantially to the length 235*b* (see FIG. 2B) of the widened section at the front opening 235 of dart holder 205 over which dart holder 205 may travel to engage and disengage for an airtight connection with launch barrel 160.

With frame 118 pulled back in the cocked position shown in FIG. 4, a gear engagement arm 402 disposed on a front end of coupling portion 118*b* is retracted from advancement mechanism 120. As illustrated in FIG. 4, advancement mechanism 120 incorporates a rear-facing rotary gear section 120*c*. In an exemplary embodiment, a leading edge on gear engagement arm 402 may engage a trailing edge on gear section 120*c* as gear engagement arm 402 is pushed forward from the configuration shown in FIG. 4 by the user pushing cocking slide 117 forward—so that rotary gear section 102*c* is pushed by gear engagement arm 402 to rotate advancement mechanism 120. According to an exemplary embodiment, respective engagement surfaces on gear engagement arm 402 and rotary gear section 120*c* of advancement mechanism 120 may also abut one another such that a pull back on gear engagement arm 402 results in a partial rotation of advancement mechanism 120 so that a next gear on rotary gear section 120*c* having corresponding engagement surfaces would abut corresponding surfaces on gear engagement arm 402 when cocking slide 117 is returned to the forward position by the user, thereby pushing gear engagement arm 402 forward to reengage gear section 120*c*.

Figure 5:
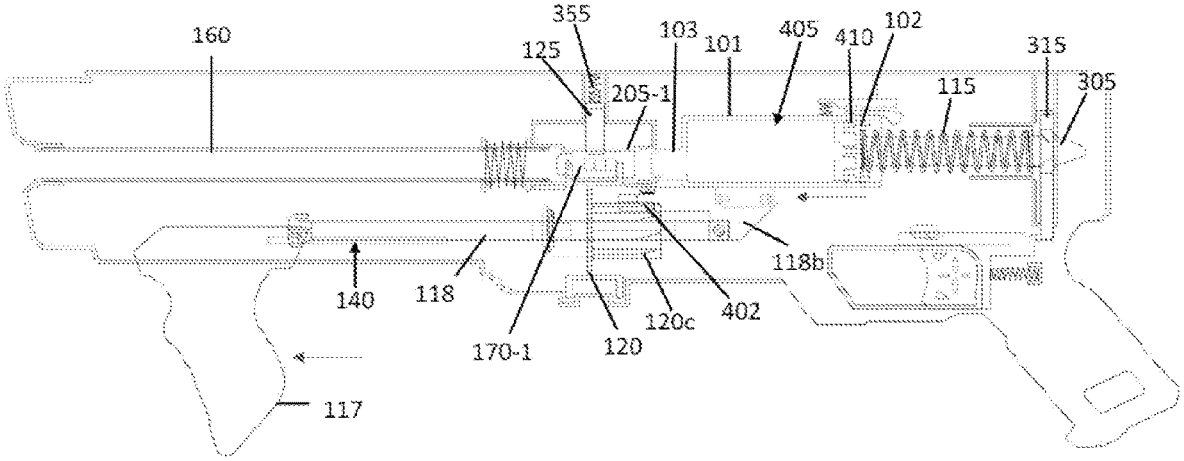
FIG. 5 is a schematic partial cross-sectional side view of the toy projectile launcher of FIG. 4 with the cocking slide or handle being returned towards a forward firing position according to an exemplary embodiment of the present disclosure.

Referring now to FIG. 5, with the notch/recess 330 of rod portion 305 engaged with plate 315, the user can push cocking slide 117 forward in a second priming step—again, in a similar fashion to a pump action rifle—see forward arrow adjacent cocking slide 117 in FIG. 5. Consequently, barrel 101 is pulled forward (see forward arrow adjacent barrel 101) towards the front of launcher 100 by reciprocating frame 118 (and coupling portion 118*b*) while rod portion 305 and plunger element 102 are held in place by plate 315. As shown in FIG. 5, compression spring 115 remains fully compressed by the return of cocking slide 117 towards its original forward position. Accordingly, plunger element 102 forms an air chamber 405 within barrel 101 whereby air is drawn in through front nozzle 103 of barrel 101. In accordance with an exemplary embodiment of the present disclosure, plunger element 102 incorporates an additional resilient O-ring 410 to further improve the seal for air chamber 405. Nozzle 103 may be of a substantially smaller diameter than that of the air chamber 405 so that a forward push by plunger 102 would expel the air through nozzle 103 at a higher pressure.

As further shown in FIG. 5, as cocking slide 117 is moved forward in the direction shown by the forward arrow, gear engagement arm 402 on the front part of coupling portion 118*b* is pushed forward to reengage with rotary gear section 102*c* of advancement mechanism 120. Again, a leading edge on gear engagement arm 402 may engage a trailing edge on gear section 120*c* as gear engagement arm 402 is pushed forward from the configuration shown in FIG. 4 by the user pushing cocking slide 117 forward—so that rotary gear section 102*c* is pushed by gear engagement arm 402 to rotate advancement mechanism 120. Correspondingly, front and rear prongs 120*a* and 120*b* are rotated (either in the clockwise or counterclockwise direction in the configuration shown in FIG. 2A—as an example, counterclockwise is illustrated) to push on the outer surfaces of dart holders 205 that are fittingly received in the openings 209. The dart holder 205-1 holding a next dart 170-1 is, thus, rotated into position in front of nozzle 103. As described above, block 125 is pushed upward by the previous dart holder 205 and is biased back down by spring 355 once the rotation to the next dart holder 205-1 is substantially complete. The fitted contours on the lower surface of block 125 works to align the next dart holder 205-1 so as to provide for inserting air piston nozzle 103 into the rear opening 230 (see FIG. 2B) of dart holder 205-1. Correspondingly, the alignment further provides for inserting the front opening 235 (see FIG. 2B) of the next dart holder 205-1 over launch barrel 160 to form an airtight seal for launching the next dart 170-1. Again, launch barrel 160 has an internal diameter that provides minimal clearance for darts 170 to allow for substantially airtight propulsion from launch barrel 160 upon release of the pressurized air from air chamber 405. As an example, the interior diameter of main portion 220 near front end 235 is slightly more than 12.9 mm (see FIG. 2B) and launch barrel 160, thus, may have approximately the same interior diameter, with an allowance for taper 347 illustrated in FIG. 3B.

Figures 6A, 6B:
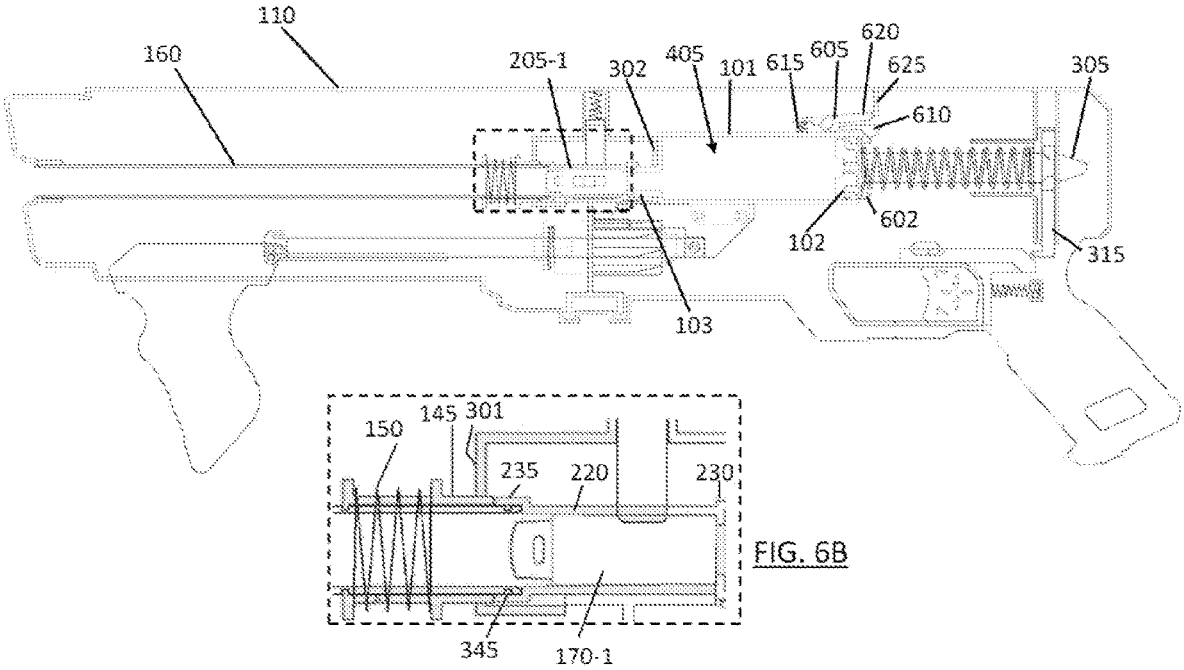
FIG. 6A is a schematic partial cross-sectional side view of the toy projectile launcher of FIG. 5 with the cocking slide or handle being returned fully to the forward firing position according to an exemplary embodiment of the present disclosure.
FIG. 6B is an inset closeup cross-sectional side view illustrating details of barrel interface assembly of the launcher shown in FIG. 6A according to an exemplary embodiment of the present disclosure.

As illustrated in FIGS. 1, 3B, and 6B, launch barrel 160 incorporates an outer O-ring 345 on its rear portion that is of a slightly smaller external diameter for fittingly inserting into front opening 235 of dart holder 205-1 (and 205), which is holding the next dart 170-1 for firing. Correspondingly, rear opening 230 of dart holder 205-1, which is holding the next dart 170-1, has a slightly larger internal diameter for receiving front nozzle 103 of barrel 101, thereby, again, providing for a substantially airtight connection from air chamber 405 to the rear surface of dart 170-1 in the launch position in dart holder 205-1 for launching through launch barrel 160. According to an exemplary embodiment of the present disclosure, nozzle 103 also incorporates an O-ring 303 (see FIG. 4) around its outer circumference to form a seal around the internal circumference of rear opening 230 of dart holder 205-1. Advantageously, airtight seals are formed from air chamber 405 though dart holder 205-1 to launch barrel 160 to further improve the airtight connection.

FIGS. 6A and 6B illustrate the completion of the forward push on cocking slide 117 by the user in the second priming step. As shown in FIG. 6A, as the cocking slide is returned fully to its forward position, air piston nozzle 103 is inserted into the rear opening 230 (see FIGS. 2B and 6B) of the next dart holder 205-1 through an opening in rear wall 302 of housing 110 and pushes forward on dart holder 205-1. FIG. 6B is a closeup of the front seal interface between dart holder 205-1 and launch barrel 160 via spring-loaded barrel interface collar 145. As shown in FIG. 6B, dart holder 205-1, having been pushed forward by nozzle 103 at its rear opening 230, pushes forward on collar 145 and compresses spring 150. Collar 145 is, thus, retracted from abutting front wall 301 of housing 110. Correspondingly, front opening 235 of dart holder 205-1 is fitted over launch barrel 160 past O-ring 345 to thereby form an airtight seal between main portion 220 of dart holder 205-1 and launch barrel 160. In this configuration illustrated in FIGS. 1 and 6A, nozzle 103 is also inserted into rear opening 230 of dart holder 205-1 (and 205) past O-ring 303 (see FIG. 4) of nozzle 103, thus forming an airtight seal between air chamber 405 and main portion 220 of dart holder 205-1 (and 205). Advantageously, when the user completes the second priming step of returning cocking slide 117 to the forward position, an airtight connection is formed between the primed air piston chamber 405 and launch barrel 160. Therefore, an improved launch force on dart 170-1 (and 170) is achieved.

With the improved airtight connection, there is a need to anchor and stabilize air piston barrel 101—for example, to minimize kickback from the compressed air that might dissipate a portion of the launch force on dart 170-1 (and 170). Accordingly, as illustrated in FIG. 6A, air piston barrel 101 incorporates a spring-loaded pivot hook 605 that includes a rearward hook element 610 adapted to engage a rear portion of plunger element 102 when air piston barrel 101 is returned fully to the forward position while plunger element 102 is held in place by virtue of the engagement between rod portion 305 and plate 315. In accordance with an exemplary embodiment, plunger element 102 includes a rearward structure 602—for example, a rearward extension around the circumference of plunger element 102—that is dimensioned to protrude from the rear portion of air piston barrel 101 when launcher 100 is in the primed configuration shown in FIG. 6A. As illustrated in FIG. 6A, this rearward structure 602 of plunger element 102 abuts and pushes a front-facing slanted surface on hook element 610 so that pivot hook 605 rotates upward around a hinge and, as a result, compresses a compression spring 615 that biases pivot hook 605 against an outer surface of barrel 101 in the opposite direction. Pivot hook 605 also incorporates a stop arm 620 that, as a result of the rotation, is also rotated upward into engagement with a wall 625 in housing 110. Consequently, stop arm 620 would abut wall 625 in the rearward direction and thereby limit any rearward movement of air piston barrel 101 during launch.

Next, a trigger pull and launch action will be described. FIG. 6A illustrates the interface between the rear portion of trigger assembly 320 and locking plate 315. As illustrated in FIG. 5, trigger assembly 320 includes an inclined (camming) surface so that, when trigger assembly 320 is pulled backward by the user, locking plate 315 is caused to move upward along inclined surface 520. In embodiments, trigger assembly 320 may be biased forward in a default position by a spring 530, or the like, such that plate 315 returns to contacting the inclined surface 520 when trigger 320 is in the forward, default, non-firing position. Again, a user can pull trigger assembly 320 backward and, as trigger assembly 320 is slid backwards, the inclined surface 520 is pushed backwards and, accordingly, slides plate 315 upward. Consequently, as plate 315 is pushed upward by the camming surface 520 of trigger assembly 320, the engagement between plate 315 and notch/recess 330 of rod portion 305 is released as aperture 310 (see FIG. 1) is moved upward to a position that clears notch/recess 330. Thus, spring 115 is released from its fully compressed state, thereby driving plunger element 102 forcefully forward back into the position shown in FIG. 1. As a result, plunger element 102 pushes and expels the collected air from air chamber 405 through nozzle 103 to launch dart 107-1 through launch barrel 160. Advantageously, with the airtight seals provided from nozzle 103, through dart holder 205-1 (and 205), to launch barrel 160, the launch force and velocity for dart 107-1 is improved. Again, with extension arm 620 abutting wall 625, air piston barrel 101 is prevented from moving backwards as the air from air chamber 405 is forcefully pushed out of nozzle 103, thus further improving the launch force on dart 107-1.

After launch, trigger assembly 320 is returned to the forward default position and plate 315 is returned to its lowered position. In addition, with plunger element 102 being returned to the forward position shown in FIG. 1 after launch, the rearward structure 602 on plunger element 102 disengages from pivot hook 605 and compression spring 615 rotates pivot hook 605 downward. As a result, extension arm 620 is rotated downward, see FIG. 1, to clear wall 625 so that cocking slide 117 may be pulled backward again to the position shown in FIG. 4 to prime a next dart 170 in belt 105.

Figures 7A, 7B:
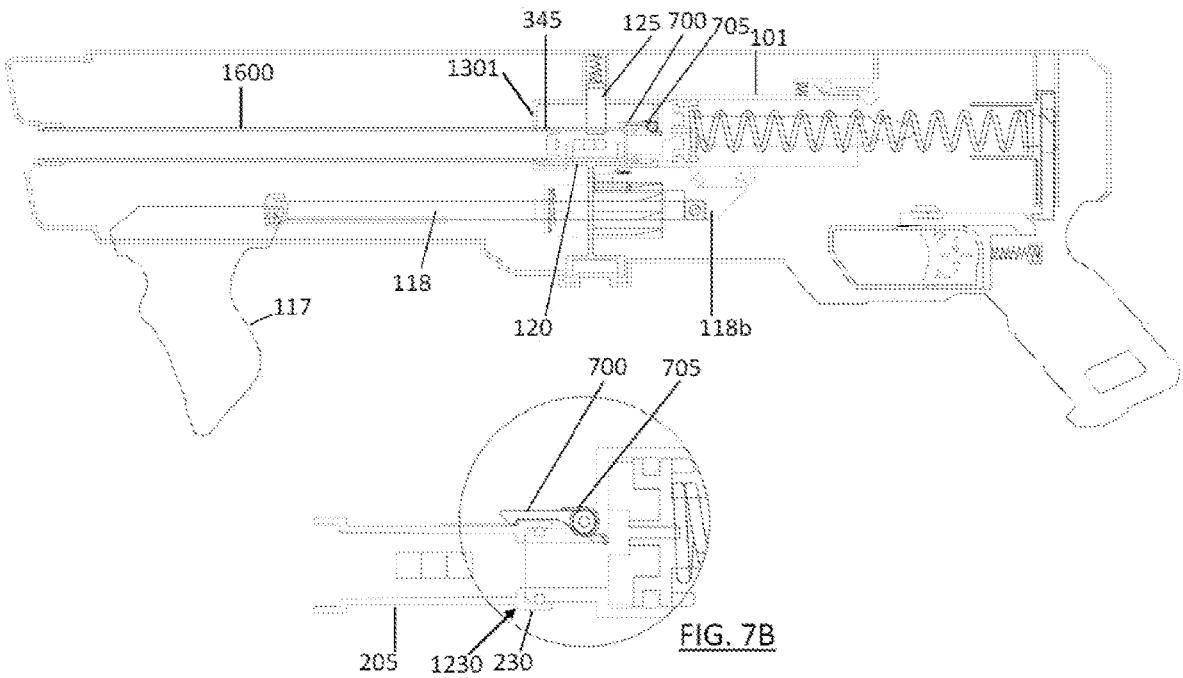
FIG. 7A is a schematic partial cross-sectional side view of key elements of a toy projectile launcher according to another exemplary embodiment of the present disclosure.
FIG. 7B is an inset closeup cross-sectional side view illustrating details of a hook element of the launcher shown in FIG. 7A according to another exemplary embodiment of the present disclosure.

Next, an alternative exemplary embodiment to the barrel interface collar 145 of launcher 100 will be described. With reference to FIG. 7A, in such an alternative embodiment, a launcher 1000 incorporates a fixed launch barrel 1600 having the same internal and external diameters as launch barrel 160 and, in place of the barrel interface collar 145 for pushing dart holder 205 backwards during a pull back on cocking slide 117 (see FIGS. 3A and 3B), a spring-loaded hook element 700 is disposed at the front air nozzle 103 of air piston barrel 101. As illustrated in FIGS. 7A and 7B, hook element 700 extends forward around an outer edge of rear opening 230 of dart holder 205 so that it hooks onto a front ledge 1230 (see FIG. 7B) formed by the widened rear opening 230 of dart holder 205. Hook element 700 may, thus, pull on the ledge 1230 on dart holder 205 as nozzle 103 is pulled back when a user pulls back on cocking slide 117. Accordingly, the opening in the rear wall 1302 of launcher 1000 is larger than the opening in rear wall 302 of launcher 100 in order to accommodate hook element 700. With the removal of barrel interface collar 145, launch barrel holder 165 shown in FIG. 1 may still be incorporated to hold launch barrel 1600 in place. However, as illustrated in FIG. 7A, the opening in front wall 1301 of launcher 1000 may be reduced in size in order to interlock with a notch on the outer surface of launch barrel 1600 to hold it in place. Launcher 1000 otherwise incorporates like elements as those of launcher 100 shown in FIGS. 1-6B, which may be denoted by the same reference numerals in FIGS. 7A-8B, and duplicative detailed descriptions of such elements and their operations will not be repeated.

FIG. 7B is an inset closeup view of hook element 700 shown in FIG. 7A. As shown in FIG. 7B, hook element 700 is biased downward by a torsion spring 705 to maintain the engagement with front ledge 1230 on dart holder 205. According to an exemplary embodiment, torsion spring 705 provides sufficient downward force to hold hook element 700 in place for retracting dart holder 205 from launch barrel 1600 but provides sufficient resiliency to disengage from front ledge 1230 once dart holder 205 is cleared from launch barrel 1600.

FIG. 8A is a schematic partial cross-sectional side view of the toy projectile launcher 1000 in a position where a user has begun pulling back on cocking slide 117 according to an exemplary embodiment of the present disclosure (in correspondence with the position shown in FIG. 3A).

As cocking slide 117 is pulled back (see rearward arrow at cocking slide 117 in FIG. 8A), air piston barrel 101 is also pushed rearward via reciprocating frame 118 (and coupling portion 118*b*). Accordingly, hook element 700 pulls on ledge 1230 so that the front opening 235 of dart holder 205 is retracted and disconnected from launch barrel 1600, as illustrated in FIG. 8A. Once dart holder 205 is pulled back sufficiently to clear at least the distance corresponding to the front length 235*b* described above (see FIG. 2B), hinges 207 on either side of dart holder 205 abut corresponding rear prongs 120*b*, which serve as a stop to the rearward movement of dart holder 205. As described above, spring 705 provides sufficient flexibility so that once dart holder 205 is stopped, the continued pull back of air piston nozzle 103 would result in hook element 700 disengaging from ledge 1230, as illustrated in FIGS. 8A and 8B, thus allowing for nozzle 103 to also retract from the rear of dart holder 205. Corresponding to FIG. 3A and as illustrated in FIG. 8A, front wall 1301 and rear wall 1302 together define an opening through which belt 105 may extend between the left and right sides of launcher 1000. In accordance with an exemplary embodiment of the present disclosure, front wall 1301 and rear wall 1302 are distanced from each other to provide for the full length of dart holder 205 of belt 105 with additional clearances at the front and back of belt 105—i.e., dart holder 205 shown in FIG. 8—so as to provide for advancing belt 105 to a next dart holder 205 either from a left side to a right side of launcher 1000, or vice versa. As the user pulls back further on cocking slide 117 (see, for example, FIG. 4), air piston nozzle 103 retracts fully, along with hook element 700, from the opening in rear wall 1302, thus clearing from the rear of dart holder 205 and belt 105 to allow for their movement and advancement.

FIG. 8B is an inset closeup view of the disengagement of hook element 700 from ledge 1230 shown in FIG. 8A. As further illustrated in FIG. 8B, hook element 700 includes a front-facing slanted surface 710 so that when cocking slide 117 is returned to the forward position in a second priming step, in correspondence with FIGS. 5-6B, front surface 710 would abut the rear end of rear opening 230 of dart holder 205. Hook element 700 would, thus, rotate upward against spring 705 and hook back onto front ledge 1230 when cocking slide 117 is returned fully to the forward position. Therefore, after launch, hook element 700 would, again, be in position to retract dart holder 205 from launch barrel 1600. With the exception of not having a barrel interface collar 145, launcher 1000 forms the front airtight seal between dart holder 205 and launch barrel 1600 in a similar fashion to the airtight seal formed between dart holder 205 and launch barrel 160 in launcher 100 described above. Thus, a duplicative detailed description will not be repeated.

Figures 9A, 9B:
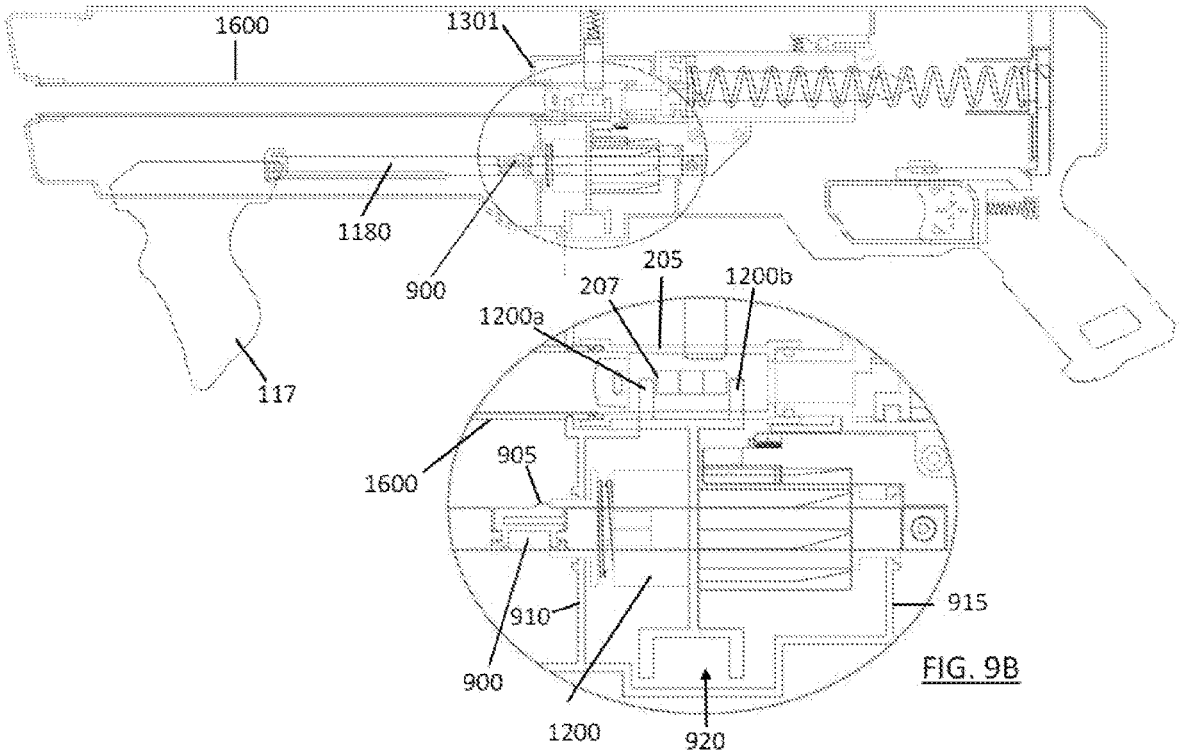
FIG. 9A is a schematic partial cross-sectional side view of key elements of a toy projectile launcher according to yet another exemplary embodiment of the present disclosure.
FIG. 9B is an inset closeup cross-sectional side view illustrating details of a resilient member of the launcher shown in FIG. 9A according to yet another exemplary embodiment of the present disclosure.

Next, another alternative exemplary embodiment to the barrel interface collar 145 of launcher 100 will be described. With reference to FIG. 9A, in such an alternative embodiment, a launcher 1005 incorporates a fixed launch barrel 1600 in the same manner as launcher 1000 shown in FIG. 7A. In place of the spring-loaded hook element 700 for pulling dart holder 205, launcher 1005 incorporates a resilient member 900 to reciprocating frame 1180 so that a notch 905 on resilient member 900 pushes on advancement mechanism 1200 in the rearward direction when cocking slide and reciprocating frame 1180 are pulled back by the user in the first priming step.

FIG. 9B is an inset closeup view of resilient member 900 on reciprocating frame 1180. As illustrated in FIG. 9B, notch 905 on resilient member 900 abuts a front edge of the central opening in advancement mechanism 1200 so that it provides a rearward push on advancement mechanism 1200 when reciprocating frame 1180 is pulled back along with cocking slide 117. As illustrated in FIGS. 9A and 9B, launcher 1005 incorporates an internal front wall 910, an internal rear wall 915, and spacing 920 to accommodate a reciprocating movement of advancement mechanism 1200—in contrast to the fixed arrangement in the forward and rearward directions of advancement mechanism 120 shown in FIGS. 1-8A. As further illustrated in FIGS. 9A and 9B, front and rear prongs 1200*a* and 1200*b* on advancement mechanism 1200 are spaced apart to fittingly sandwich hinges 207 between dart holders 205 so that a movement of advancement mechanism 1200 in the forward and rearward directions would translate to a similar movement of dart holder 205. According to an exemplary embodiment, resilient member 900 provides sufficient rigidity so that notch 905 would push advancement mechanism 1200 with sufficient force to, in turn, retract dart holder 205 from launch barrel 1600. For illustrative purposes, a front view of resilient member 900 is provided in FIG. 2A to indicate its position. It should be readily understood that resilient member 900 is not incorporated in launcher 100 described above with reference to FIGS. 1-6B and that its incorporation in FIG. 2A, again, is solely for illustrative purposes here.

FIG. 10A is a schematic partial cross-sectional side view of the toy projectile launcher 1005 in a position where a user has begun pulling back on cocking slide 117 according to an exemplary embodiment of the present disclosure (in correspondence with the position shown in FIG. 3A).

As cocking slide 117 is pulled back (see rearward arrow at cocking slide 117 in FIG. 10A), notch 905 pushes on a front end of advancement mechanism 1200, which is thus moved in the rearward direction until a rear end of advancement mechanism 1200 is stopped by rear wall 915 (see also FIG. 10B). With the rearward movement of advancement mechanism 1200, front prongs 1200*a* push on a front part of hinges 207 to thereby move dart holder in the rearward direction and to retract and disconnect dart holder 205 from launch barrel 1600. According to an exemplary embodiment, rear wall 915 is disposed at a position such that advancement mechanism 1200 is moved backwards until dart holder 205 is pulled back sufficiently to clear at least the distance corresponding to the front length 235*b* described above (see FIG. 2B). Once the rear part of advancement mechanism 1200 abuts rear wall 915 and is stopped, resilient member 900 flexes inward to allow notch 905 to clear the front part of advancement mechanism 1200, as illustrated in FIGS. 10A and 10B. The user is, therefore, able to continue pulling back on cocking slide 117 and to continue pulling back air piston nozzle 103, thus allowing for nozzle 103 to also retract from the rear of dart holder 205. Corresponding to FIG. 3A and as illustrated in FIGS. 10A and 10B, front wall 910 and rear wall 915 together define the front and rear clearance for the above-described movement of advancement mechanism 1200. In accordance with an exemplary embodiment of the present disclosure, front wall 910 and rear wall 915 are distanced from each other to provide for the movement of advancement mechanism 1200 to cover at least the retraction and reconnection of dart holder 205 to launch barrel 160 over the front length 235*b* (see FIG. 2B) described above—so as to provide for advancing belt 105 to a next dart holder 205 either from a left side to a right side of launcher 1005, or vice versa. As the user pulls back further on cocking slide 117 (see, for example, FIG. 4), air piston nozzle 103 retracts fully from the opening in rear wall 1302, thus clearing from the rear of dart holder 205 and belt 105 to allow for their movement and advancement.

Figure 10C:
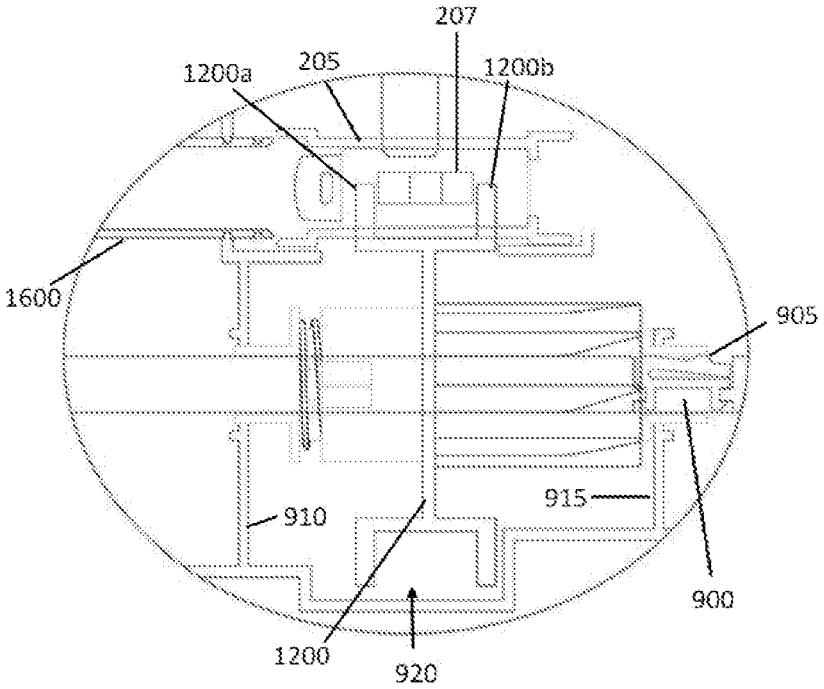
FIG. 10C is an inset closeup cross-sectional side view illustrating details of the resilient member of the launcher shown in FIGS. 9A and 10A being pulled further rearward when the cocking slide or handle is placed at or near the loading and priming (cocked) position according to yet another exemplary embodiment of the present disclosure.

FIG. 10B is an inset closeup view of the compressed resilient member 900 that is able to be moved through the central opening in advancement mechanism 1200. FIG. 10C is a closeup view of resilient member 900 positioned proximate the rear end of the central opening in advancement mechanism 1200. When the cocking slide 117 is pulled back completely—in correspondence with the position shown in FIG. 4—resilient member 900 would be moved past the rear part of the central opening in advancement mechanism 1200 and, therefore, return to its original shape illustrated in FIG. 9B. Thus, when cocking slide 117 is returned to the forward position in a second priming step, in correspondence with FIGS. 5-6B, a front surface on notch 905 would abut the rear end of the central opening of advancement mechanism 1200. Notch 905 would, thus, push advancement mechanism 1200 back to the forward position shown in FIGS. 9A and 9B until a front part of advancement mechanism 1200 abuts front wall 910, at which point dart holder 205-1 of a next dart 170-1 would be connected to launch barrel 1600 to form an airtight seal in a manner similar to the above-described embodiments. With the forward movement of advancement mechanism 1200 stopped by front wall 910, resilient member 900 compresses again to fit through the central opening in advancement mechanism 1200 to return to the position illustrated in FIGS. 9A and 9B. In embodiments, notch 905 may be symmetrical between the front and the back or, as illustrated in FIGS. 9A-10B, may incorporate front and rear surfaces that have differing slant angles to account for the forces needed to push advancement mechanism 1200 in the rearward and forward directions, respectively, before resilient member 900 compresses in the manner described above. Launcher 1005 otherwise operates in a similar manner to launchers 100 and 1000 and, thus, a duplicative detailed description will not be repeated.

Although the exemplary embodiment is described in the context of a foam bullet/dart launcher that utilizes shortened foam bullets/darts, it is to be understood that the two-step priming/loading and firing action according to the present disclosure could be applied to a toy projectile launcher of other types of projectiles (e.g. a ball or the like) or a fluid launcher whereby the fluid from a reservoir in the handle is driven by a plunger. In such environment the two-step priming/pumping action of the present disclosure enables a handheld high-velocity fluid burst launcher.

While particular embodiments of the present disclosure have been shown and described in detail, it would be obvious to those skilled in the art that various modifications and improvements thereon may be made without departing from the spirit and scope of the disclosure. It is therefore intended to cover all such modifications and improvements that are within the scope of this disclosure.

What is claimed is:

1. A toy projectile launcher comprising:

a housing;

an air piston assembly, the air piston assembly including an air piston barrel, a plunger element, a first compression spring, and a front air nozzle;

a cocking slide coupled to the air piston barrel;

a launch barrel; and a storage belt including a plurality of projectile holders, wherein each projectile holder is adapted to contain a projectile, wherein, when the cocking slide is moved from a forward position to a backward position in a first priming step and, after the first priming step, from the backward position to the forward position in a second priming step:

an internal air chamber is formed between a front portion of the air piston barrel and the plunger element;

an advancement mechanism of the storage belt advances a next projectile holder into a firing position in front of the front air nozzle; and the front air nozzle of the air piston assembly pushes forward on a rear portion of the next projectile holder, forming an airtight seal between the air piston barrel and the rear portion of the next projectile holder, wherein an airtight seal is formed between a front portion of the next projectile holder and a rear portion of the launch barrel, and an airtight seal is formed between the air piston barrel and the rear portion of the launch barrel.

2. The toy projectile launcher of claim 1, wherein, when the cocking slide is moved from the forward position to the backward position, a front portion of the air piston barrel pushes the plunger element to compress the first compression spring against a rear wall of the housing, wherein the plunger element and compression spring are held in place by a latching assembly.

3. The toy projectile launcher of claim 2, wherein the latching assembly is coupled between the plunger element and a trigger assembly, wherein the trigger assembly is adapted to be pulled backward by a user of the toy projectile launcher.

4. The toy projectile launcher of claim 3, wherein, when the trigger assembly is pulled backward, the coupling of the latching assembly between the plunger element and trigger assembly is released, and the plunger element is pushed forward by the compression spring to expel air from the internal air chamber through the air nozzle disposed on the front portion of the air piston barrel behind the next projectile holder in the firing position.

5. The toy projectile launcher of claim 4, wherein the next projectile holder has a rear opening for accommodating the front air nozzle, wherein the rear opening has a diameter that is greater than a diameter of a central portion of the next projectile holder.

6. The toy projectile launcher of claim 1, wherein the plunger element incorporates a first resilient O-ring that forms an airtight seal between the plunger element and an internal surface of the air piston barrel.

7. The toy projectile launcher of claim 6, wherein a second resilient O-ring is disposed around an outer circumference of the rear portion of the launch barrel so as to form an airtight seal between the rear portion of the launch barrel and a front end of the next projectile holder.

8. The toy projectile launcher of claim 7, wherein a third resilient O-ring is incorporated around an outer circumference of the front air nozzle so as to form an airtight seal between the front air nozzle and the rear portion of the next projectile holder.

9. The toy projectile launcher of claim 5, further comprising:

a barrel interface collar fitted over the launch barrel; and a second compression spring that biases the barrel interface collar in a rearward direction, wherein, when the cocking slide is moved from the forward position to the backward position:

the front air nozzle is retracted from a rear portion of a first projectile holder of the plurality of projectile holders, wherein the first projectile holder is in the firing position in front of the front air nozzle;

the second compression spring pushes the barrel interface collar in the rearward direction and away from the launch barrel; and the barrel interface collar pushes the first projectile holder away from the launch barrel, wherein the retraction of the front air nozzle provides a clearance for the advancement mechanism to advance the next projectile holder into the firing position; and wherein, when the cocking slide is moved from the backward position to the forward position:

the next projectile holder pushes forward on the barrel interface collar, compressing the second compression spring, wherein the front portion of the next projectile holder is fitted over the rear portion of the launch barrel.

10. The toy projectile launcher of claim 9, wherein the barrel interface collar pushes the first projectile holder at least 6 mm, in the rearward direction relative to an adjacent projectile holder.

11. The toy projectile launcher of claim 9, wherein the front air nozzle pushes the next projectile holder forward at least 6 mm relative to an adjacent projectile holder.

12. The toy projectile launcher of claim 5, wherein the front air nozzle has a spring-loaded hook element disposed thereon;

wherein, when the cocking slide is moved from the forward position to the backward position:

the spring-loaded hook element engages and pulls on a front ledge formed by a rear opening of the first projectile holder, pulling the first projectile holder in a rearward direction away from the launch barrel; and when the first projectile holder is pulled a predetermined distance in the rearward direction, the spring-loaded hook element disengages from the front ledge of the rear opening of the first projectile holder;

wherein, when the cocking slide is moved from the backward position to the forward position:

the spring-loaded hook element engages a front ledge of the rear opening of the next projectile holder; and a front end of the next projectile holder is fitted over a rear portion of the launch barrel.

13. The toy projectile launcher of claim 12, wherein the first projectile holder is pulled back at least 6 mm relative to an adjacent projectile holder.

14. The toy projectile launcher of claim 5, further comprising:

a reciprocating frame;

a resilient member coupled to the reciprocating frame wherein the cocking slide coupled to the air piston barrel, the projectile holder advancement mechanism, and the resilient member; and wherein, when the cocking slide is moved from the forward position to the backward position:

the resilient member engages and pushes the projectile holder advancement mechanism in a rearward direction;

the projectile holder advancement mechanism moves a first projectile holder in the rearward direction away from the launch barrel; and when the rotatable projectile holder advancement mechanism is moved a predetermined distance, the resilient member disengages from the projectile holder advancement mechanism; and the front air nozzle is retracted from a rear portion of a first projectile holder of the plurality of projectile holders, wherein the retraction of the front air nozzle provides a clearance for the storage belt to advance a next projectile holder into the firing position; and wherein, when the cocking slide is moved from the backward position to the forward position:

the resilient member engages and pushes the projectile holder advancement mechanism in a forward direction;

the projectile holder advancement mechanism moves the next projectile holder in the forward direction;

the front air nozzle pushes forward on a rear portion of the next projectile holder; and a front end of the next projectile holder is fitted over a rear portion of the launch barrel.

15. The toy projectile launcher of claim 14, wherein, when the cocking slide is moved from the forward position to the backward position, the resilient member pushes the projectile holder advancement mechanism by at least 6 mm in the rearward direction.

16. The toy projectile launcher of claim 14, wherein, when the cocking slide is moved from the backward position to the forward position, the resilient member pushes the projectile holder advancement mechanism to move the next projectile holder by at least 6 mm in the forward direction.

17. The toy projectile launcher of claim 1, wherein the projectiles are foam darts.

* * * * *